US005953436A

United States Patent [19]

Zimmermann

[11] Patent Number: 5,953,436

[45] Date of Patent: Sep. 14, 1999

[54] APPARATUS FOR GENERATING AN AUDIBLE TONE

[75] Inventor: Daniel E. Zimmermann, Peoria, Ill.

[73] Assignee: Caterpillar Inc., Peoria, Ill.

[21] Appl. No.: 08/896,795

[22] Filed: Jul. 18, 1997

[51] Int. Cl.[6] ..... H04R 1/00; H04R 9/06; H04R 1/02

[52] U.S. Cl. ..... 381/396; 381/412; 381/340; 381/417; 340/388.1; 340/391.1

[58] Field of Search ..... 381/340, 341, 381/343, 411, 412, 413, 417, 420, 423, 398, FOR. 154, FOR. 159, FOR. 201; 340/388.5, 391.1, 392.1, 398.2, 397.1, 396.1, 388.1, 388.4

[56] References Cited

U.S. PATENT DOCUMENTS

| | | | |
|---|---|---|---|
| 4,075,626 | 2/1978 | Sakaguchi et al. | 340/388 |
| 4,090,041 | 5/1978 | Mori et al. | 179/115 |
| 4,134,200 | 1/1979 | Frigo | 29/594 |
| 4,147,899 | 4/1979 | Mori et al. | 381/417 |
| 4,374,624 | 2/1983 | Murata | 368/250 |
| 4,391,532 | 7/1983 | Hara | 368/250 |
| 4,418,247 | 11/1983 | Hansen | 179/115.5 |
| 4,615,105 | 10/1986 | Wada et al. | 29/594 |
| 4,723,296 | 2/1988 | Nieuwendijk et al. | 381/398 |
| 4,803,733 | 2/1989 | Carver et al. | 381/398 |
| 4,813,123 | 3/1989 | Wilson et al. | 29/593 |
| 4,868,882 | 9/1989 | Ziegenberg et al. | 381/423 |
| 5,107,540 | 4/1992 | Mooney et al. | 381/398 |
| 5,111,510 | 5/1992 | Mitobe | 381/193 |
| 5,425,002 | 6/1995 | Plisek et al. | 381/398 |
| 5,432,758 | 7/1995 | Sone | 381/398 |
| 5,467,323 | 11/1995 | Sone | 381/398 |
| 5,521,886 | 5/1996 | Hirosawa et al. | 367/174 |
| 5,590,210 | 12/1996 | Matsuo et al. | 381/199 |
| 5,604,816 | 2/1997 | Totani | 381/412 |
| 5,625,700 | 4/1997 | Sone | 381/192 |
| 5,642,233 | 6/1997 | Imahori et al. | 381/398 |
| 5,673,330 | 9/1997 | Chang | 381/398 |
| 5,729,617 | 3/1998 | Gruber | 381/412 |
| 5,751,827 | 5/1998 | Takahashi | 381/340 |
| 5,764,784 | 6/1998 | Sato et al. | 381/412 |

*Primary Examiner*—Curtis A. Kuntz
*Assistant Examiner*—Rexford N Barnie
*Attorney, Agent, or Firm*—Mario J. Donato, Jr.

[57] ABSTRACT

An apparatus for generating a audible tone is disclosed. The apparatus includes a ferromagnetic container 105, a ferromagnetic pole 110, a coil 115, a first stationary lead wire 175, a second stationary lead wire 180, and a flexible ferromagnetic diaphragm 120. The ferromagnetic pole 110 is disposed within the ferromagnetic container 105. The coil 115 is encircling a portion of the ferromagnetic pole 110. The coil 115 has an input end 165 connected to a first stationary lead wire 175, configured to receive an electrical signal, and an output end 170 connected to a second stationary lead wire 180. The flexible ferromagnetic diaphragm 120 is disposed along the top edge 135 of the ferromagnetic container 105. The flexible ferromagnetic diaphragm 120 is configured to flex when magnetically attracted toward the ferromagnetic pole 110. As the flexible ferromagnetic diaphragm 120 flexes the first stationary lead wire 175 and the second stationary lead wire 180 will remain stationary.

14 Claims, 3 Drawing Sheets

PRIOR ART

APPARATUS FOR GENERATING AN AUDIBLE TONE

TECHNICAL FIELD

This invention relates generally to an apparatus for generating an audible tone and more particularly to a noise generating transducer associated with an alarm device.

BACKGROUND ART

Noise generating transducers are used for converting an input electrical signal to an output audible tone. Currently, noise generating transducers are used in the alarm devices of various types of machines and vehicles. Earth moving machines, utility vehicles, garbage trucks, and school buses are all examples of machines or vehicles that may use an alarm device. Alarm devices are typically used to warn people in the surrounding area that a machine or a vehicle is moving, such as in a backward motion.

An alarm device having a conventional noise generating transducer with an attached moving coil type of diaphragm is shown in FIG. 1, as an example. The diaphragm 10 is typically made of a rigid plastic material in the shape of a spherical dome. Along the circumference of the diaphragm 10 is a corrugated ring like structure 15. The corrugated ring like structure 15 is designed to expand and contract, allowing the diaphragm 10 to move. The moving coil 20, is attached to the diaphragm 10. Flexing wire leads 25*a–b*, connected to each end of the attached moving coil 20, are used to input and output an electrical signal.

The attached moving coil 20 and the flexing wire leads 25*a–b* are typically made of a braided copper wire. The conventional noise generating transducer 5 includes a ceramic ring permanent magnet 30 located radially around the inside rim of the transducer housing 35. A first magnetic member 40 is also located radially around the inside rim of the transducer housing 35, and a second magnetic member 45 is located near the center of the transducer housing 35 and beneath the diaphragm 10. A gap between the top of the second magnetic member 45 and the diaphragm 10 allows the diaphragm 10 to move.

A mechanical force on the attached moving coil 20 is produced by the interaction of the current, from an electrical signal input, to the attached moving coil 20 and the magnetic field disposed radially across the gap between the first magnetic member 40 and the second magnetic member 45. An audible tone is produced by the oscillating movement of the diaphragm 10.

However, with the moving diaphragm type of alarm device, problems with the flexing wire leads 25*a–b* may occur. Due to the flexing wire leads 25*a–b* being connected to each end of the attached moving coil 20, the flexing wire leads 25*a–b* have to move with the oscillation of the diaphragm 10. The point of connection between the flexing wire leads 25*a–b* and the attached moving coil 20 may sever due to the stress placed on the connection by the movement. Also, a crimp may form in the flexing wire leads 25*a–b* due to the flexing wire leads 25*a–b* being forced to move with the oscillating movement of the diaphragm 10. The crimp may eventually lead to a breakage of the flexing wire leads 25*a–b*.

The present invention is directed to overcoming one or more of the problems as set forth above.

DISCLOSURE OF THE INVENTION

In one aspect of the present invention, an apparatus for generating an audible tone in an alarm device is disclosed.

The alarm device includes a noise generating transducer. The noise generating transducer includes a ferromagnetic container, a ferromagnetic pole, a coil, a first stationary lead wire, a second stationary lead wire, and a flexible ferromagnetic diaphragm. The ferromagnetic container includes a substantially annular bottom plate and a continuous side. The continuous side has a bottom edge and a top edge. The bottom edge of the continuous side is disposed along the perimeter of the substantially annular bottom plate defining a cavity therein. The ferromagnetic pole is disposed within the cavity. The ferromagnetic pole has a first end and a second end. The second end is adjacent to the substantially annular bottom plate. The coil is encircling a portion of the ferromagnetic pole. The coil has an input end, and an output end. The first stationary lead wire is connected to the input end, and the second stationary lead wire is connected to the output end. The flexible ferromagnetic diaphragm is disposed along the top edge of the continuous side, essentially enclosing the cavity. The flexible ferromagnetic diaphragm is configured to flex when magnetically attracted toward the ferromagnetic pole.

These and other aspects and advantages of the present invention, as defined by the appended claims, will be apparent to those skilled in the art from reading the following specification in conjunction with the drawings and the claims.

BRIEF DESCRIPTION OF THE DRAWINGS

For a better understanding of the invention, reference may be made to the accompanying drawings, in which.

BEST MODE FOR CARRYING OUT THE INVENTION

Figure 1:
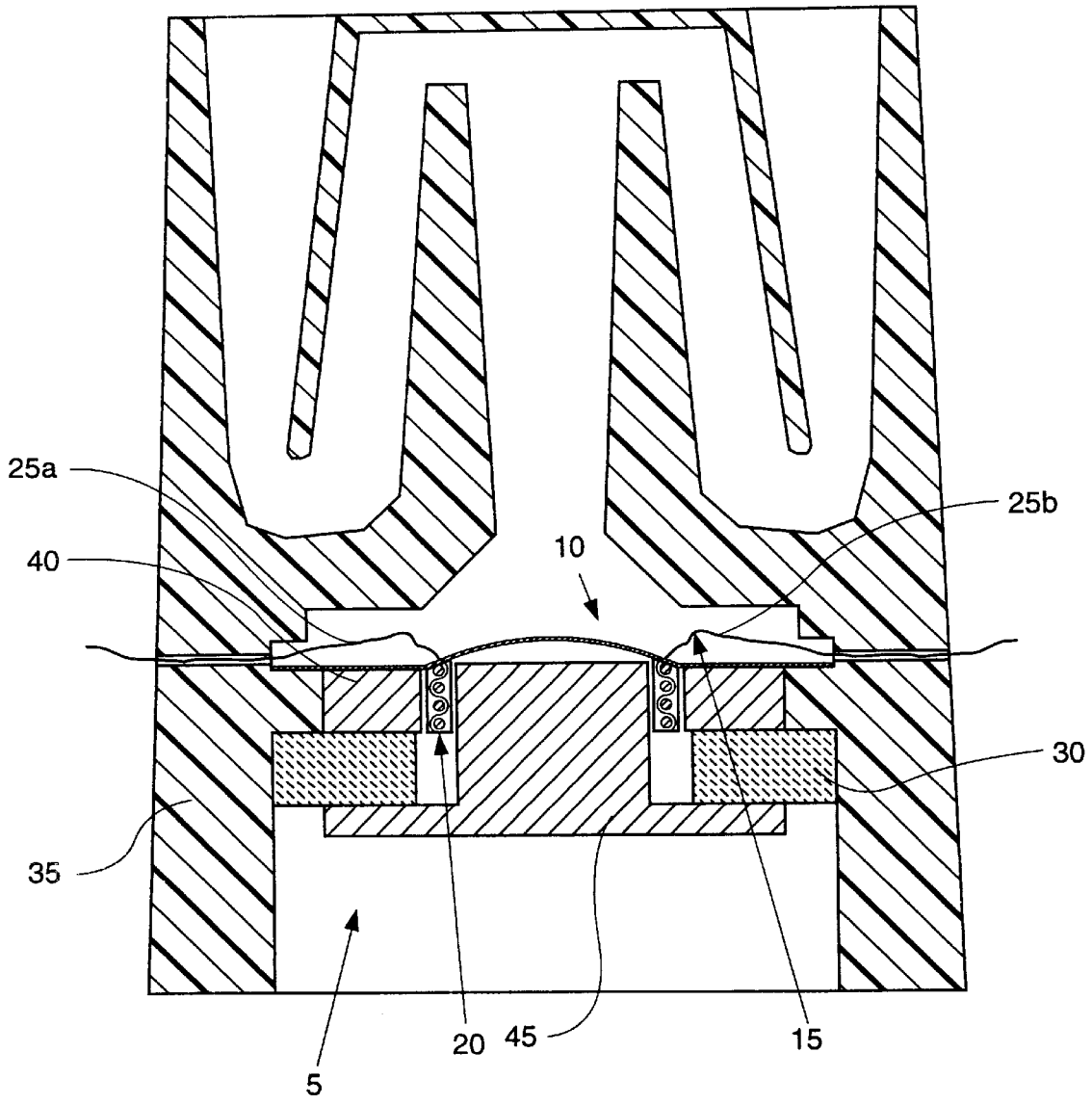
FIG. 1 is a cross-sectional view illustrating a conventional noise generating transducer.
Figure 2:
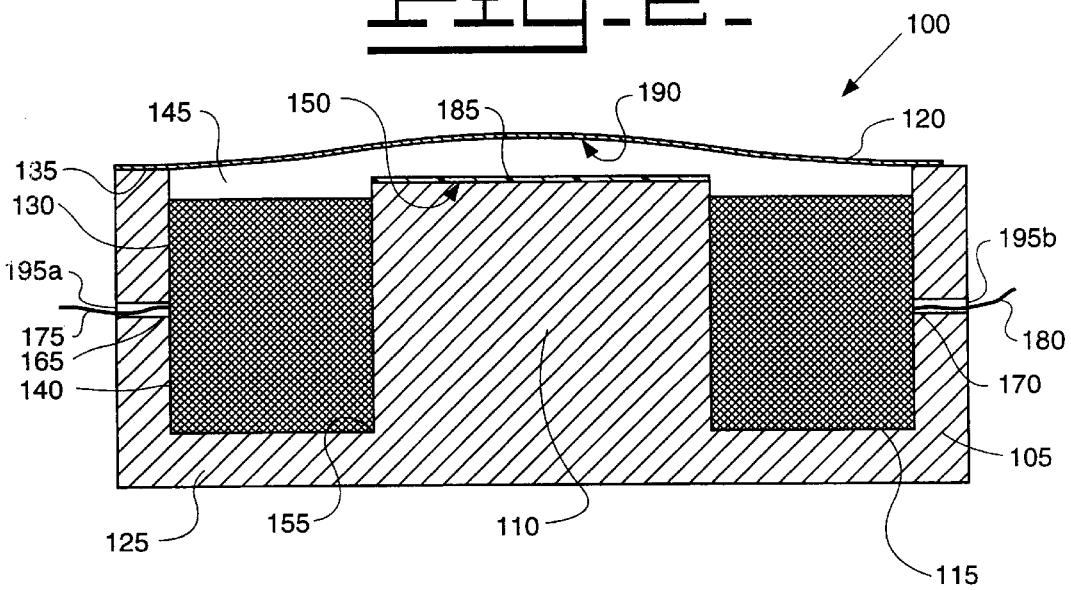
FIG. 2 is a cross-sectional view illustrating a preferred embodiment of the noise generating transducer of the present invention.

Referring to FIG. 2, a cross-sectional view illustrating a preferred embodiment of the noise generating transducer is shown. The noise generating transducer 100 includes a ferromagnetic container 105, a ferromagnetic pole 110, a coil 115, and a flexible ferromagnetic diaphragm 120.

The ferromagnetic container 105 is comprised of a substantially annular bottom plate 125 and a continuous side 130. The continuous side 130 includes a top edge 135 and a bottom edge 140. The bottom edge 140 is disposed along the perimeter of the substantially annular bottom plate 125 defining a cavity 145 therein.

The flexible ferromagnetic diaphragm 120 is disposed along the top edge 135 of the ferromagnetic container 105 substantially enclosing the cavity 145. In the preferred embodiment, the flexible ferromagnetic diaphragm 120 is composed of a dome shaped thin soft-iron, that is case hardened to produce a high degree of elasticity. However, one skilled in the art can readily implement the present invention in connection with a diaphragm composed of any type of flexible ferromagnetic material.

The ferromagnetic pole 110 is composed of a ferromagnetic material, having a first end 150 and second end 155.

The ferromagnetic pole 110 is located inside the cavity 145 and is substantially parallel to the continuous side 130. The second end 155 of the ferromagnetic pole 110 is adjacent to the substantially annular bottom plate. The first end 150 is located at a predetermined distance beneath the flexible ferromagnetic diaphragm 120. The predetermined distance will be dependent on the flexibility of the flexible ferromagnetic diaphragm 120. In the preferred embodiment, the surface area of the first end 150 of the ferromagnetic pole 110 and the surface area of the top edge 135 of the continuous edge are about the same.

The coil 115 is encircling a portion of the ferromagnetic pole 110 and filling a substantial amount of the cavity 145 between the ferromagnetic pole 110 and the continuous side 130. The coil 115 has an input end 165 and an output end 170. A first stationary lead wire 175 is connected to the input end 165 of the coil 115. A second stationary lead wire 180 is connected to the output end 170 of the coil 115. At least one of an orifice 195*a–b* , located in the ferromagnetic container 105, is configured to allow passage of the first stationary lead wire 175 and the second stationary lead wire 180.

The flexible ferromagnetic diaphragm 120 has an internal side 190 facing the ferromagnetic pole 110. An optional non-ferromagnetic spacer 185 is located between the first end 150 of the ferromagnetic pole 110 and the internal side 190 of the flexible ferromagnetic diaphragm 120. The non-ferromagnetic spacer 185 is composed of a non-ferromagnetic substance and prevents the internal side 190 from making contact with the first end 150. The non-ferromagnetic spacer 185 reduces the wear that may result from two ferromagnetic materials continually contacting each other. The non-ferromagnetic spacer 185 is attached to either the internal side 190 of the flexible ferromagnetic diaphragm 120 or on the first end 150 of the ferromagnetic pole 110.

Figure 3:
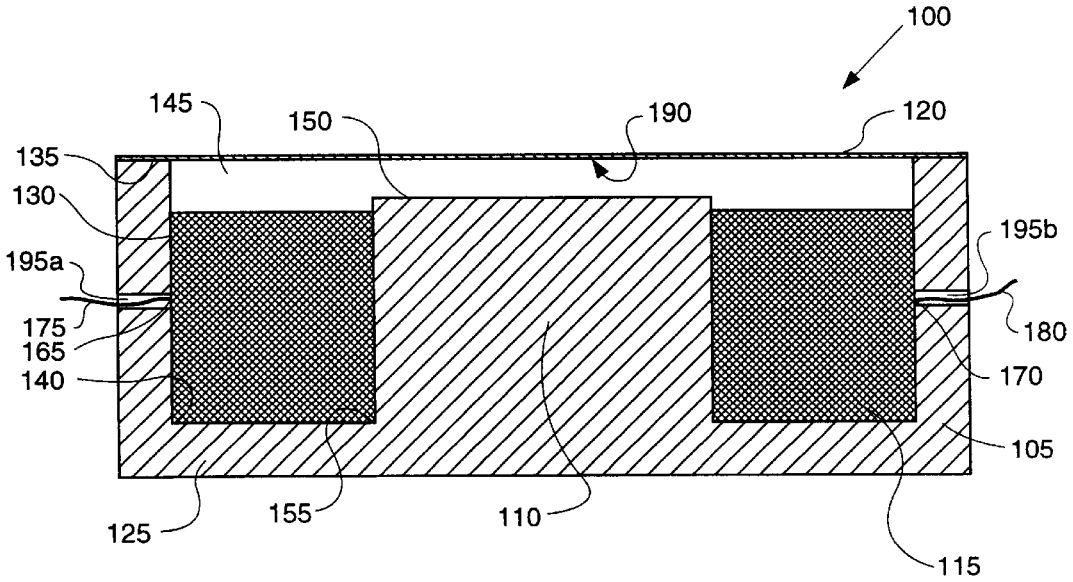
FIG. 3 is a cross-sectional view illustrating another embodiment of the noise generating transducer, including a different embodiment for the flexible ferromagnetic diaphragm, of the present invention.

Referring to FIG. 3, a cross-sectional view illustrating another embodiment of the noise generating transducer 100 is shown. The flexible ferromagnetic diaphragm 120 is a flat shape.

Figure 4:
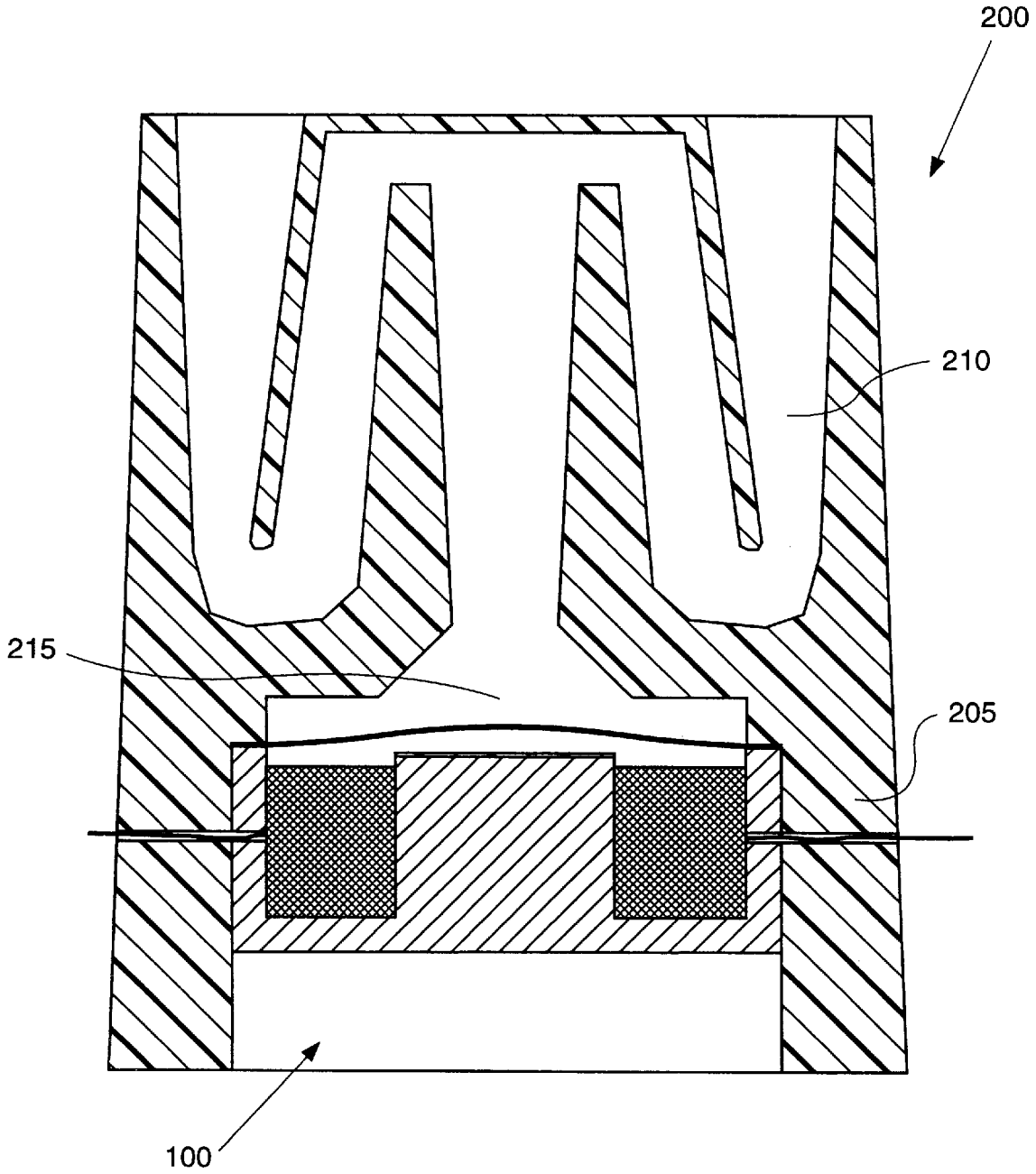
FIG. 4 is a cross-sectional view illustrating an alarm device including a noise generating transducer and a horn.

Referring to FIG. 4, a cross-sectional view illustrating an alarm device is shown. The alarm device 200 includes an alarm housing 205, the noise generating transducer 100, and a horn 210. The alarm housing 205 is configured to hold the noise generating transducer 100, and the horn 210. The horn 210 has a horn diaphragm end 215 located a predetermined distance from the flexible ferromagnetic diaphragm 120. In the preferred embodiment, the horn 210 is a folded horn type well known in the art.

When an electrical signal is applied to the first stationary lead wire 175 an electromagnet is produced from the interaction of the current through the coil 115 and the magnetic field disposed across the distance between the first end pole 150 and the top edge 135. The second stationary lead wire 180 is used to complete the electrical circuit. The flexible ferromagnetic diaphragm 120 is configured to flex when magnetically attracted toward the ferromagnetic pole 110. As the flexible ferromagnetic diaphragm 120 flexes the first stationary lead wire 175 and the second stationary lead wire 180 will remain stationary.

In the preferred embodiment, the electrical signal is a pulse signal. The electromagnet will be turned on and off with the rising and falling of the pulse signal. The flexible ferromagnetic diaphragm 120 will oscillate as the electromagnet is turned on and off, thereby producing an audible sound. The horn 210 will amplify the noise, creating an alarm type noise. Although, the preferred embodiment is discussed with respect to the electrical signal being a pulse signal, one skilled in the art could readily implement the present invention in connection with the electrical signal being another type of signal, such as, a sinusoidal signal or a ramp signal.

The dome shaped thin soft-iron will compress as the flexible ferromagnetic diaphragm 120 is magnetically attracted toward the ferromagnetic pole 110. The flat shaped thin soft-iron will stretch as the flexible ferromagnetic diaphragm 120 is magnetically attracted toward the ferromagnetic pole 110.

Industrial Applicability

The alarm type noise, produced by the alarm device 200, is typically used as a warning signal on various types of machines and vehicles. For example, earth moving machines are typically large machines with a single operator. Due to the size and shape of the machine, the operator may be unable to see what is within a few feet of the machine. An alarm device 200, located on the earth moving machine, can be configured to produce an alarm type noise in the form of a warning signal whenever the earth moving machine is backing up. In this situation, the warning signal is used to alert people within the surrounding area that the earth moving machine is backing up.

I claim:

1. An apparatus for generating an audible tone in an alarm device, comprising:

a ferromagnetic container, said ferromagnetic container including a substantially annular bottom plate, said ferromagnetic container including a continuous side, said continuous side having a bottom edge disposed along the perimeter of the substantially annular bottom plate defining a cavity therein, and said continuous side having a top edge;

a ferromagnetic pole, said ferromagnetic pole being disposed within said cavity, said ferromagnetic pole having a first end, said ferromagnetic pole having a second end, and said second end of said ferromagnetic pole being adjacent to said substantially annular bottom plate;

a coil, said coil encircling a portion of said ferromagnetic pole, said coil having an input end, and said coil having an output end;

a first lead wire, said first lead wire being connected to said input end of said coil, and said lead wire being configured to deliver an electrical signal to said coil;

a second lead wire, said second lead wire being connected to said output end of said coil, and said second lead wire being configured to output said electrical signal from said coil; and a flexible ferromagnetic diaphragm, said flexible ferromagnetic diaphragm being disposed along said top edge of said continuous side essentially enclosing said cavity, said ferromagnetic diaphragm being configured to flex when magnetically attracted toward said ferromagnetic pole.

2. An apparatus as set forth in claim 1 including said ferromagnetic pole being substantially parallel to said continuous side.

3. An apparatus as set forth in claim 1 including said coil filling a substantial amount of said cavity between said ferromagnetic pole and said continuous side.

4. An apparatus as set forth in claim 1 including said flexible ferromagnetic diaphragm having a dome shape protruding away from said ferromagnetic pole.

5. An apparatus as set forth in claim 1 including said flexible ferromagnetic diaphragm having a flat shape.

6. An apparatus as set forth in claim 1 including said first end of said ferromagnetic pole being a predetermined distance from said flexible ferromagnetic diaphragm.

7. An apparatus as set forth in claim 1 including said flexible ferromagnetic diaphragm having an internal side, said internal side facing said ferromagnetic pole.

8. An apparatus as set forth in claim 7 including a non-ferromagnetic space relocated between said internal side and said first end, said non-ferromagnetic spacer being configured to prevent contact between said flexible ferromagnetic diaphragm and said first end.

9. An apparatus as set forth in claim 8 including said non-ferromagnetic spacer being located on said internal side of said flexible ferromagnetic diaphragm.

10. An apparatus as set forth in claim 8 including said non-ferromagnetic spacer being located on said first end of said ferromagnetic pole.

11. An apparatus as set forth in claim 1 wherein said ferromagnetic container includes at least one of an orifice, said orifice being configured for passage of said first lead wire and for passage of said second lead wire.

12. An apparatus as set forth in claim 1 including a horn, said horn having a diaphragm end, and said diaphragm end of said horn being located a predetermined distance from said flexible ferromagnetic diaphragm.

13. An apparatus as set forth in claim 12 wherein said horn is a folded horn.

14. An apparatus as set forth in claim 12 including an alarm housing, said alarm housing being configured to hold said ferromagnetic container, said alarm housing being configured to hold flexible erromagnetic diaphragm, and said alarm housing being configured to hold said horn.

* * * * *